US010408520B2

(12) United States Patent
Visin

(10) Patent No.: US 10,408,520 B2
(45) Date of Patent: Sep. 10, 2019

(54) AIRFLOW CONTAINMENT DEVICE FOR AN ICE MAKER

(71) Applicant: WHIRLPOOL CORPORATION, Benton Harbor, MI (US)

(72) Inventor: Jerry M. Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 338 days.

(21) Appl. No.: 14/855,556

(22) Filed: Sep. 16, 2015

(65) Prior Publication Data

US 2017/0074572 A1 Mar. 16, 2017

(51) Int. Cl.

| | |
|---|---|
| ***F25C 5/06*** | (2006.01) |
| ***F25C 1/24*** | (2018.01) |
| ***F25D 17/06*** | (2006.01) |

(52) U.S. Cl.

CPC ..... *F25C 5/06* (2013.01); *F25C 1/24* (2013.01); *F25D 17/065* (2013.01); *F25C 2400/10* (2013.01); *F25D 2317/061* (2013.01); *F25D 2317/062* (2013.01); *F25D 2317/063* (2013.01); *F25D 2317/067* (2013.01)

(58) Field of Classification Search

CPC .... F25C 1/04; F25C 1/24; F25C 5/005; F25C 5/06; F25D 17/065; F25D 17/08; F25D 23/061; F25D 23/062; F25D 23/063; F25D 23/066; F25D 23/067

See application file for complete search history.

(56) References Cited

U.S. PATENT DOCUMENTS

| | | | | |
|---|---|---|---|---|
| 7,762,092 | B2 | 7/2010 | Tikhonov et al. | |
| 2008/0034780 | A1* | 2/2008 | Lim | F25C 1/04 62/353 |
| 2009/0178430 | A1 | 7/2009 | Jendrusch et al. | |
| 2010/0313594 | A1* | 12/2010 | Lee | F25C 1/00 62/340 |
| 2013/0167576 | A1* | 7/2013 | Kim | F25C 1/00 62/344 |
| 2014/0165611 | A1* | 6/2014 | Boarman | F25C 1/18 62/3.63 |

FOREIGN PATENT DOCUMENTS

| | | | | |
|---|---|---|---|---|
| GB | 870517 A | * | 6/1961 | F23D 11/06 |
| JP | 11173736 A | | 7/1999 | |
| JP | 20036130509 A | | 5/2003 | |
| KR | 1157704 B1 | | 6/2012 | |
| WO | 2008056957 A2 | | 5/2008 | |

OTHER PUBLICATIONS

U.S. Food and Drug Administration, FDA Consumer Health Information, "Are You Storing Food Safely?", Apr. 2014.*

* cited by examiner

*Primary Examiner* — Elizabeth J Martin
(74) *Attorney, Agent, or Firm* — Price Heneveld LLP

(57) ABSTRACT

A refrigerator having an ice maker in the door, an ice maker air duct in the ice compartment door, and an inlet and a plurality of flutes. The inlet is in fluid communication with the duct outlet and the flutes are configured to separate an air flow through the ice maker air duct into substantially evenly distributed air flows. Each of the plurality of flutes terminate proximate a row of ice wells.

20 Claims, 8 Drawing Sheets

AIRFLOW CONTAINMENT DEVICE FOR AN ICE MAKER

BACKGROUND

In the typical refrigerator ice maker, it is at times desirable to freeze ice in a shorter amount of time. In an icemaker located in a refrigerated compartment that is held above the freezing point of water, air below the freezing point of water must be delivered to the ice maker. In the typical refrigerator, this air is delivered from the freezer compartment via a duct or series of ducts and a fan.

SUMMARY OF THE PRESENT DISCLOSURE

One aspect of the present disclosure includes a refrigerator with a freezer compartment and a refrigerator compartment. The freezer compartment is kept at a temperature generally below the freezing point of water, and the refrigerator compartment is held at a temperature generally above the freezing point of water. The refrigerator has a door for selectively accessing an interior portion of the refrigerator appliance. The door has an ice compartment with an icemaker and at least one duct, typically a single duct, leading from the freezer compartment to the ice compartment. The duct has a duct inlet in the freezer compartment and a duct outlet in the refrigerator compartment. The ice maker is in the door and located within the ice compartment including an ice tray with rows of ice wells. The refrigerator has an ice maker air duct in the ice compartment door, and it has an inlet and a plurality of flutes. The inlet is in fluid communication with the duct outlet and the flutes are configured to separate an air flow through the ice maker air duct into substantially evenly distributed air flows. Each of the plurality of diverter flutes terminate proximate a row of ice wells.

Another aspect of the present disclosure includes a refrigerator with a freezer compartment and a refrigerator compartment, wherein the freezer compartment is kept at a temperature generally below the freezing point of water, and the refrigerator compartment is held at a temperature generally above the freezing point of water. The refrigerator has a door for selectively accessing an interior portion of the refrigerator appliance. The door has an ice compartment configured to house an icemaker. The refrigerator also has one or more duct leading from the freezer compartment to the ice compartment. The duct or ducts typically have a duct inlet disposed in the freezer compartment, and a duct outlet disposed in the refrigerator compartment. The refrigerator has an ice maker disposed within the door and located within the ice compartment. The ice maker has an ice tray with a plurality of rows of ice wells. The refrigerator has an air flow diverter underneath the ice tray. The air flow diverter has air channels corresponding to and configured to direct air underneath the rows of ice wells.

Yet another aspect of the present disclosure includes a refrigerator having a freezer compartment and a refrigerator compartment. The freezer compartment is kept at a temperature generally below the freezing point of water, and the refrigerator compartment is held at a temperature generally above the freezing point of water. The refrigerator has a door for selectively accessing an interior portion of the refrigerator appliance. The door has an ice compartment to house an icemaker. The refrigerator also has one or more, but typically a single duct leading from the freezer compartment to the ice compartment, the duct(s) typically include a duct inlet disposed in the freezer compartment and a duct outlet disposed in the refrigerator compartment. The refrigerator has an ice maker disposed within the door and located within the ice compartment. The ice maker includes an ice tray including a plurality of rows of ice wells. There is an air flow diverter underneath the ice tray, the air flow diverter having a plurality of air channels to direct air underneath the rows of ice wells. The refrigerator also has an ice maker air duct disposed within the ice compartment door, the ice maker air duct having an inlet and a plurality of flutes. The inlet is in fluid communication with the duct outlet, the plurality of flutes are configured to separate an air flow through the ice maker air duct into a plurality of substantially evenly distributed air flows, and each of the plurality of diverter flutes terminate next to a row of ice wells.

These and other aspects, objects, and features of the present invention will be understood and appreciated by those skilled in the art upon studying the following specification, claims, and appended drawings.

DETAILED DESCRIPTION OF EMBODIMENTS

Figure 1:
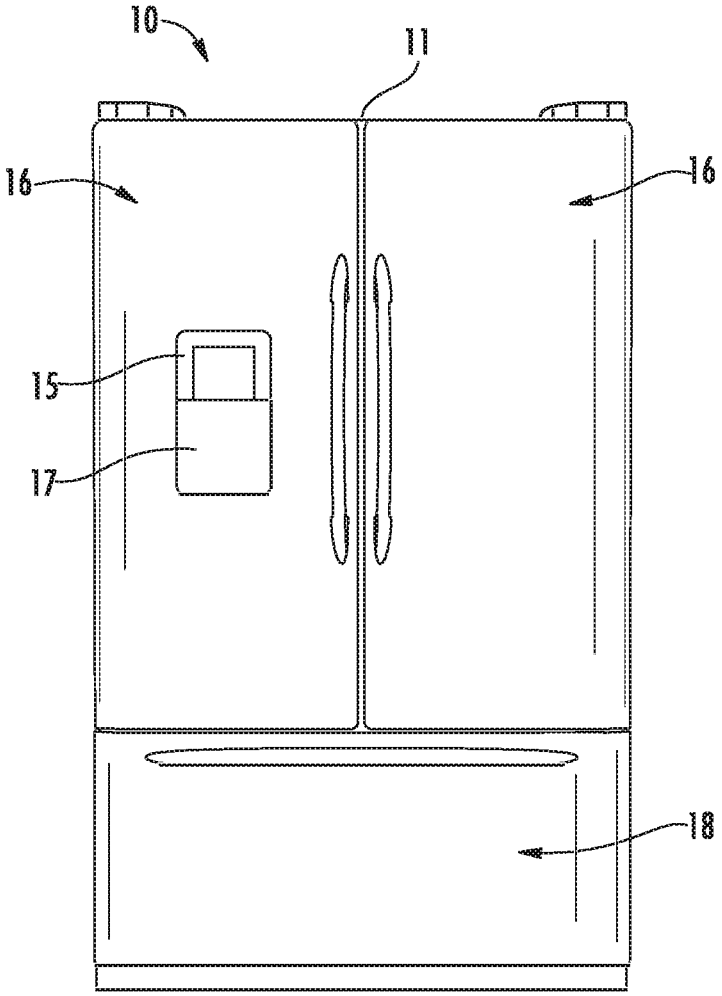
FIG. 1 is an elevated front view of a French-Door Bottom Mount type refrigerator.

For purposes of description herein, The terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, reference numeral 10 generally designates a refrigerator with an automatic ice maker 20. As described below, an automatic ice maker is an ice maker either as a stand-alone appliance, or within another appliance such as a refrigerator. The ice making process is typically induced, carried out, stopped, and the ice is harvested with substantially no user input or no user input.

Figure 2:
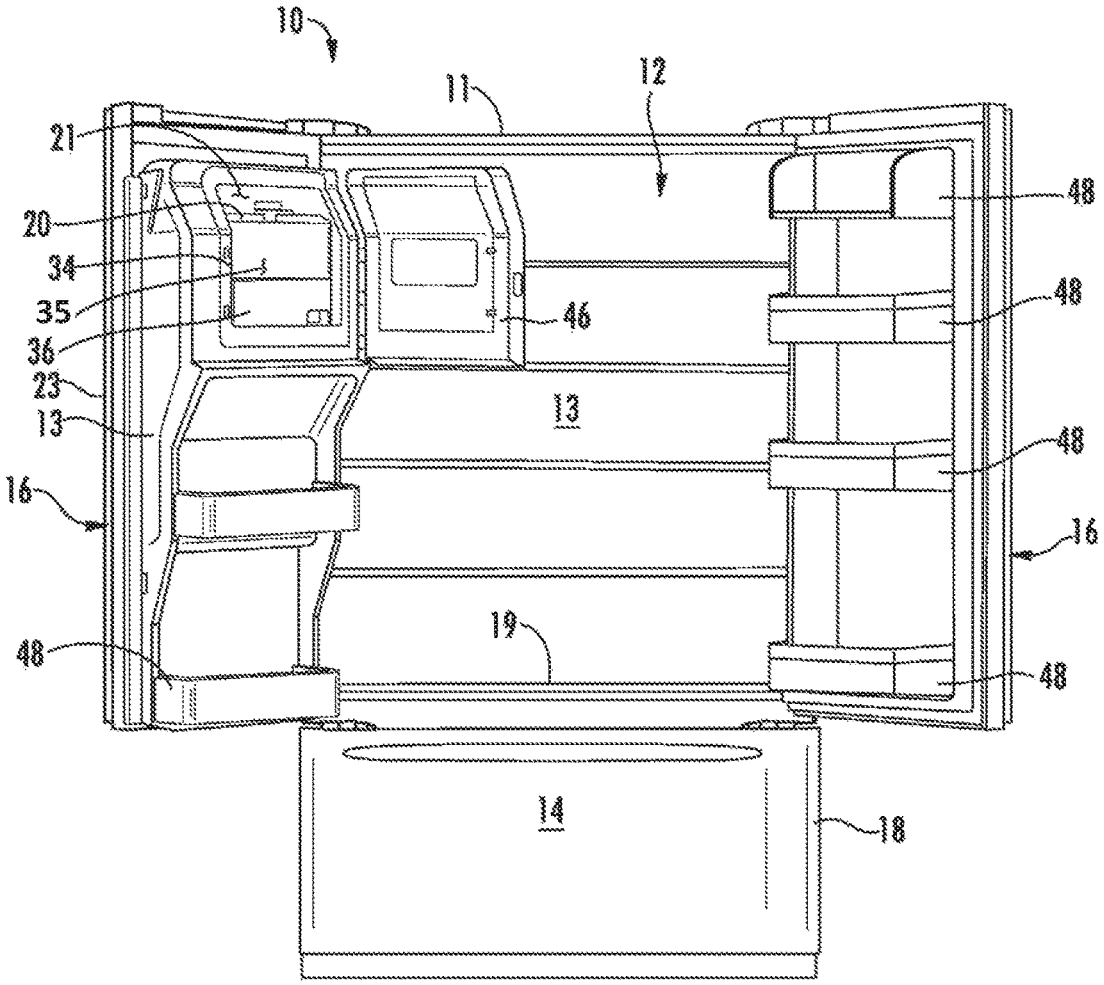
FIG. 2 is an elevated front view of a French-Door Bottom Mount type refrigerator with the refrigerator compartment doors open.

FIG. 1 generally shows a refrigerator of the French-door bottom mount type, but it is understood that this disclosure could apply to any type of refrigerator, such as a side-by-side, two-door bottom mount, or a top-mount type refrigeration unit. As shown in FIGS. 1 and 2, the refrigerator may have a fresh food compartment 12 configured to refrigerate and not freeze consumables within the fresh food compartment, and a freezer compartment 14 configured to freeze consumables within the freezer compartment during normal use. More typically, the refrigerator has a cabinet 11, and a liner 13 within the cabinet 11 to define the refrigerator compartment 12 and the freezer compartment 14. The refrigerator compartment 12 and the freezer compartment 14 are typically separated by a mullion 19.

The refrigerator may have one or more doors 16, 18 that provide selective access to the interior volume of the refrigerator where consumables may be stored. As shown, the fresh food compartment doors are designated 16, and the freezer door is designated 18. It may also be shown that the fresh food compartment may only have one door 16. The doors 16 also typically have a liner 13, with at least one door 16 typically having an ice maker receiving space 21. The doors 16 may also typically have one or more bins 48 attached to the doors.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F. As shown in FIG. 2, an ice maker 20 may be located on a door 16 to the refrigerator compartment 12. As described below, an ice maker is defined as an assembly of a bracket, a motor, an ice tray, a bail arm connected to the motor, at least one wire harness and at least one thermistor.

The door 16 typically has an outer door skin 23 and a liner 13. The door 16 may include an ice maker and ice bin access door 46 hingedly connected to one of the refrigerator doors along the side proximate the hinge for the refrigerator door carrying the ice maker, i.e. the vertical edge closest to the cabinet. The hinge may be a single or multiple hinge(s) and may be spaced along the entire edge, substantially the entire edge of more frequently two hinges may be used with one close to the top edge of the access door 46 and one close to the bottom edge-of the access door.

Significantly, due at least in part to the access door 46, the ice maker's design and size, the door has a peripheral edge liner that extends outward from the access door 46 surface and defines a dike wall. The dike walls extend from at least the two vertical sides, more typically all four sides. The access door 46 is selectively operable between an open position, in which the ice maker 20 and the ice storage bin are accessible, and a closed position, in which the ice maker 20 and the ice storage bin are not accessible. While not typically the case, the ice maker 20 may also be located exterior the refrigerator compartment, such as on top of the refrigerator cabinet, in a mullion between the refrigerator compartment and the freezer compartment, in a mullion between two refrigerator compartments, or anywhere else an automatic, motor driven ice maker may be located.

Figure 3:
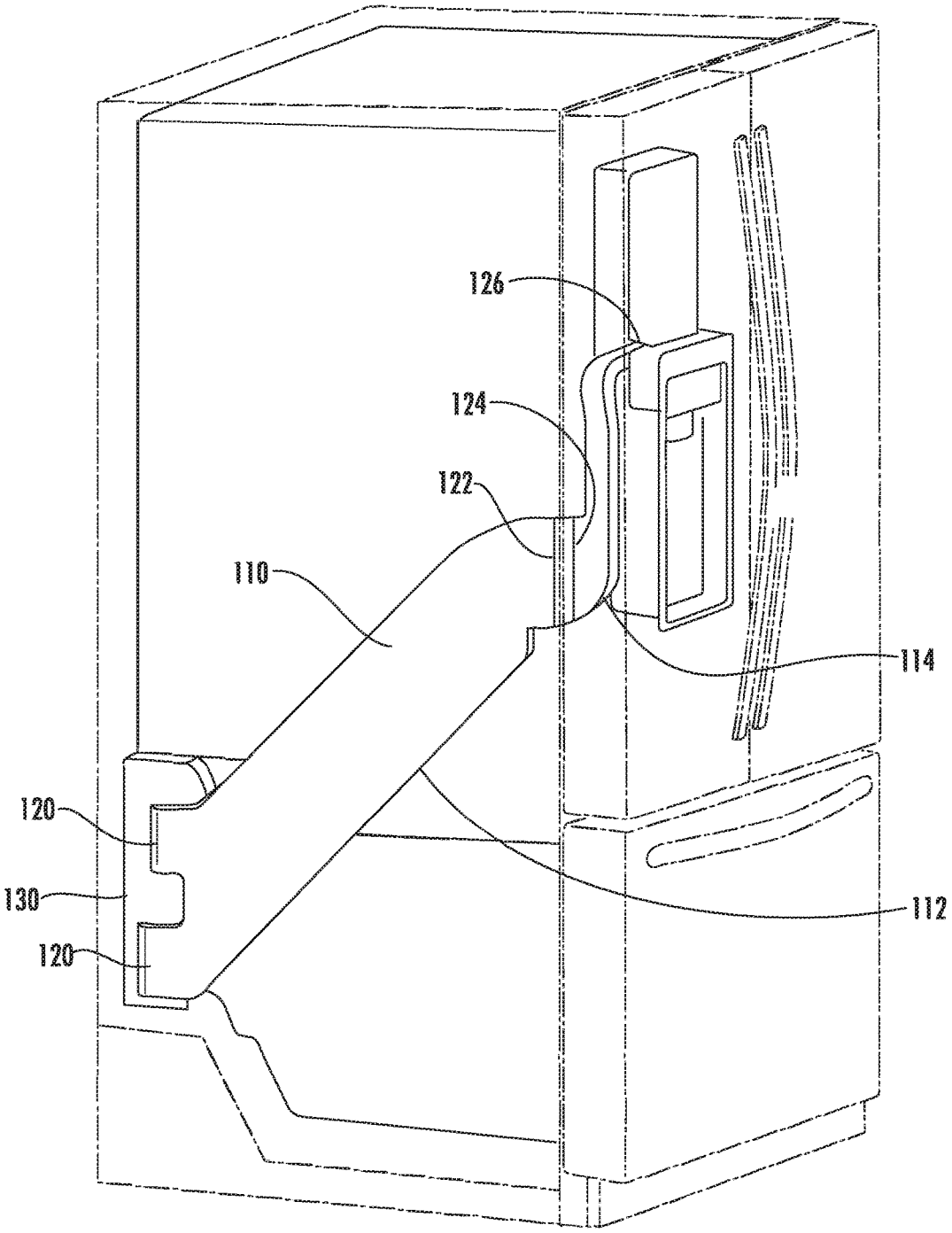
FIG. 3 is an isometric view of the refrigerator with the cabinet removed showing the ducting system of the refrigerator.

As shown in FIG. 3, the refrigerator may also have one or more duct or a plurality of ducts that form a duct system 110. The duct system 110 typically has an inlet in the freezer compartment 14 and an outlet, which may be positioned in the fresh food compartment 12. The duct system 110 may be situated such that the length of the duct system 110 necessary to direct air from the freezer compartment 14 to the fresh food compartment 12 is minimized, reducing the amount of heat gained in the travel between the inlet and the outlet. The duct system 110 is typically made up of at least two ducts that abut one another to create an airflow path when the door containing the ice maker is closed. A refrigerator cabinet duct 112 and a door duct 114 may form the airflow path. The cabinet duct 112 typically has one or more inlets 120 disposed in the freezer compartment, and at least one outlet 122, but conceivably a plurality of outlets, disposed in the refrigerator compartment. More typically, the cabinet duct outlet 122 is situated between the liner 13 for the refrigerator compartment 12 and the cabinet 11 along one side of the refrigerator cabinet 12.

The door duct 114 is typically disposed within the refrigerator door 16, and has an inlet 124 and an outlet 126. The duct 114 is typically located between the door outer skin 23 and the door liner 13, and is typically inaccessible to an end user of the refrigerator during normal use. The door duct inlet 124 is typically located on a rear-facing plane of the door 16 and is sized substantially the same or the same as the cabinet duct outlet 122 and configured to make an at least substantially air tight or air tight seal between the door duct inlet 124 and the cabinet duct outlet 122. The door duct inlet 124 is located on the door 16 to substantially match the location of the cabinet duct outlet 122 when the door 16 is closed. The door duct outlet 126 is typically substantially rectangularly shaped and is situated adjacent the ice maker assembly 20 as shown in FIG. 3 at a height substantially even with the bottom of the ice tray 28. The duct outlet 126 may also be any other shape appropriate for the given refrigerator configuration, such as substantially round.

If the ice maker 20 is located in a compartment or location other than in the freezer compartment 12, a fan is typically needed to force the air to the ice maker 20. The refrigerator may have more than one fan, but typically has a single fan located in a fan box 130 adjacent the freezer compartment 14 to force air from the freezer compartment 14 to the fresh food compartment 12. The colder air from the freezer compartment 14 is needed in the ice maker 20 because air below the freezing point of water is needed to freeze the water that enters the ice maker 20 to freeze into ice cubes. In the embodiment shown in the figures, the ice maker is located in the fresh food compartment 12, which typically holds air above the freezing point of water. The fan or fans also may be located either in the freezer compartment 14, the fresh food compartment 12, or in another location where the fan is able force air through the duct or any combination of locations if a plurality of fans are employed.

The ice maker assembly is often positioned within a door 16 and more typically in an ice maker receiving space 21 of the appliance to allow for delivery of ice through the door 16 in a dispensing area 17 on the exterior of the appliance, typically at a location on the exterior below the level of the ice storage bin to allow gravity to force the ice down an ice dispensing chute into the refrigerator door. The chute extends from the bin to the dispenser area 17 and ice is typically pushed into the chute using ice an electrically power driven auger. Ice is dispensed from the ice storage bin to the user of the appliance.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water one or more water outlets, typically one outlet for water is in the dispensing area and another to an ice tray. The refrigerator may also have a control board or controller (not shown) that sends electrical signals to the one or more valves when prompted by a user through a user interface 15, typically on the front face of a door 16, that water is desired or if an ice making cycle is required.

Figure 4:
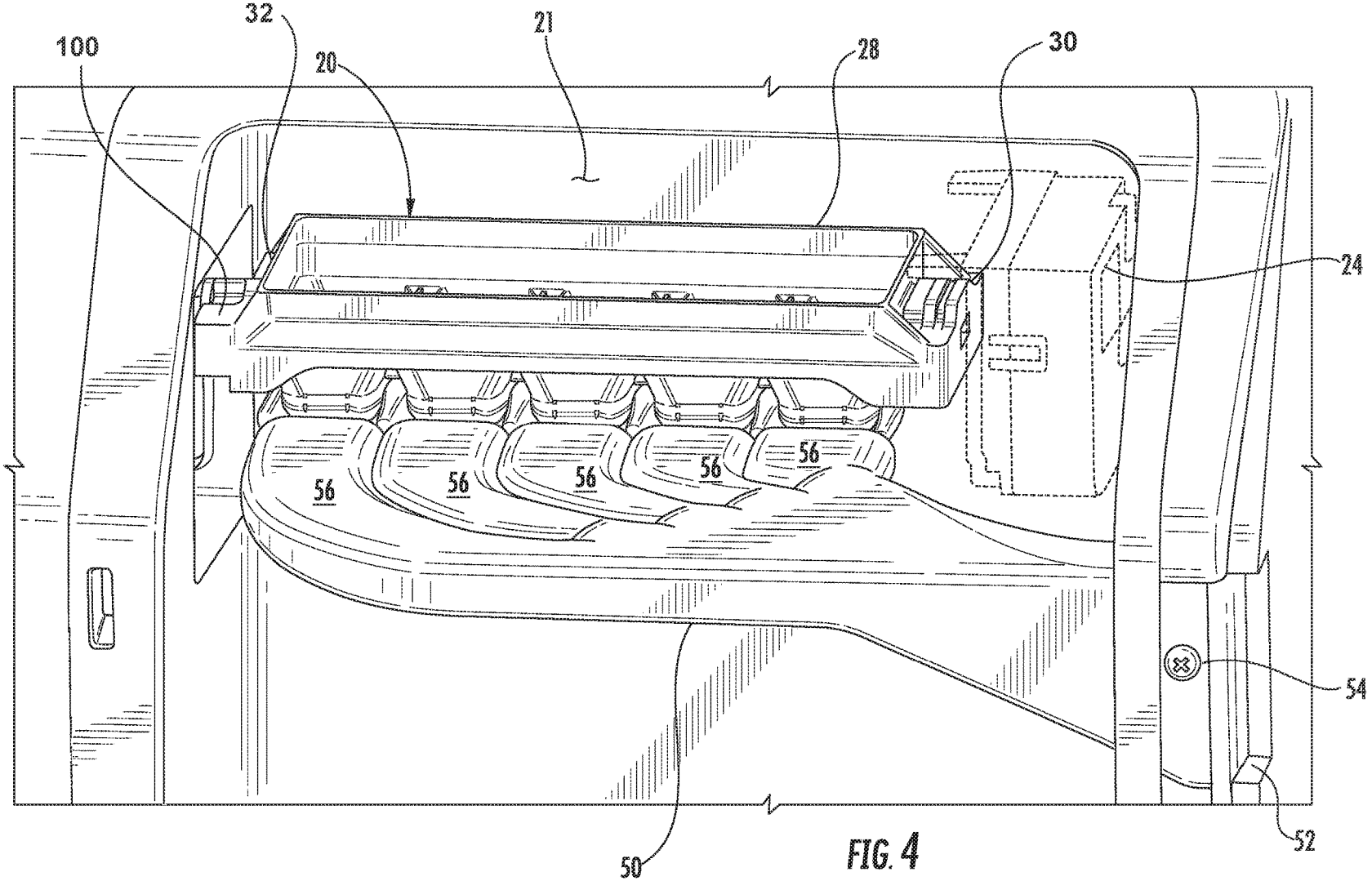
FIG. 4 is a view of the ice maker showing the ice maker duct.
Figure 5:
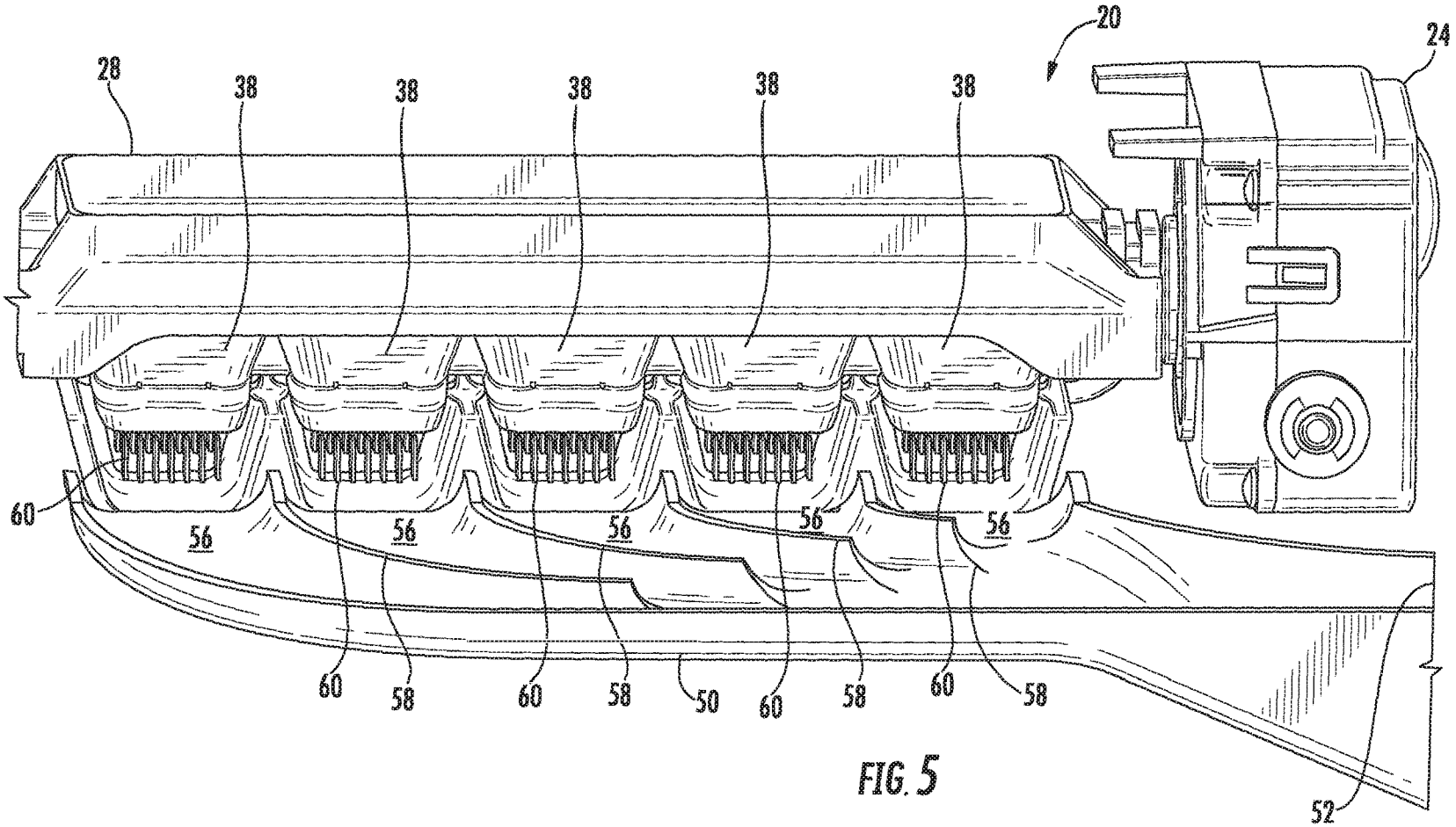
FIG. 5 is a view of the ice maker with the top of the ice maker duct removed showing the flutes in detail.
Figure 6:
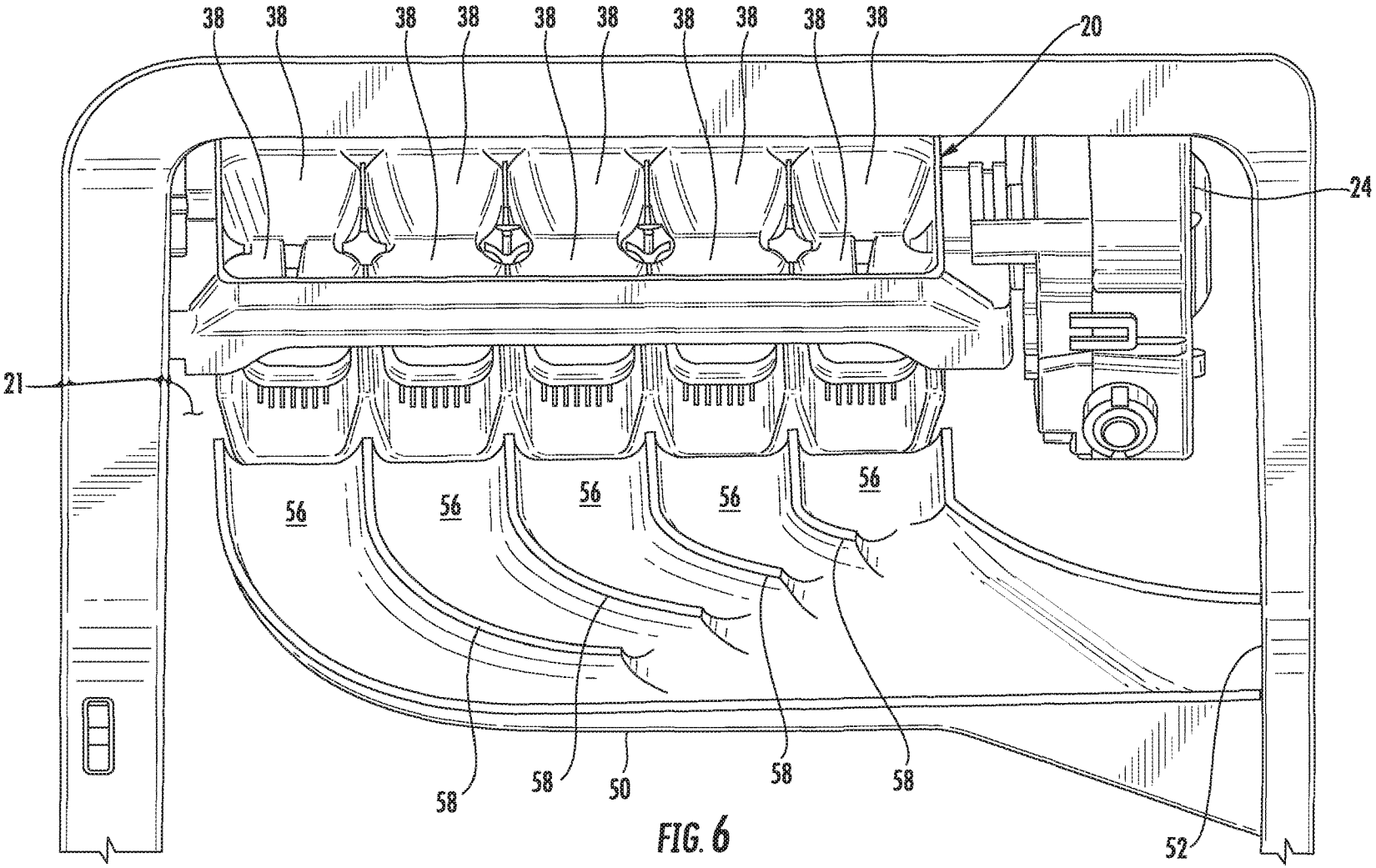
FIG. 6 is another view of the ice maker with the top of the ice maker duct removed showing the relationship between the ice maker duct and the air diverter.

FIGS. 4-6 show an enlarged view of the ice making assembly according to one aspect of the present disclosure and demonstrates one feature of the present disclosure, namely, the ice maker duct 50, which typically has a plurality of flutes 56, each separated by a flute wall 58. The ice maker duct 50 typically has an inlet 52 that is substantially the same size and shape as the door duct outlet 126, and is located to substantially line up with the door duct outlet 126 to allow airflow from the door duct outlet 126 into the inlet 52. The duct 50 may be held in place by a fastener 54, or by any other means of securing a duct in place known in the art such as a snap fit. The ice maker duct inlet 52 is typically a single, substantially rectangular shaped opening configured to match the shape and size of the door duct outlet 126, but the shape could be any shape. The ice maker duct 50 is shaped into a plurality of substantially rectangular shaped flutes 56 at an end distal the inlet 52. To separate airflow within the duct 50 from a single flow of air at the inlet 52 into a plurality of substantially similar airflows at the flutes 56, flute walls 58 are interposed within the duct 50.

FIGS. 5 and 6 show the ice maker with the top of the duct 50 cutaway to see the walls 58 in more detail. The flute walls 58 are typically configured to separate the flow of air into a plurality of flows that are substantially the same across all of the flutes 56. In order to accomplish this, the cross sectional area of the flutes 56 at the upstream end of the flute walls 58 is manipulated by changing the position of the flute walls 58 such that substantially the same amount of air flow streams into each flute 56. The flutes 56 closer to the inlet 52 are typically smaller at the upstream end than the flutes 56 farther away from the inlet 52. Ideally, the air flow is balanced across all of the flutes 56, freezing all the ice cubes within the ice wells 38 substantially simultaneously, which reduces cycle time. The balancing can also be achieved by adjusting the curvature of the flute walls and/or increasing or decreasing the inlet size for air entering the inlet of the flute. Generally speaking the flute that directs air to the ice maker portion that is furthest from the cold air intake has the longest airflow path and longest curvilinear portion whereas the flute proximate the intake has the shortest airflow path and the shortest curvilinear portion. The number of flutes 56 typically corresponds to the number of rows of ice wells 38 in the ice tray for the ice maker. In the embodiment shown, the ice tray 28 has 5 rows of ice wells 38, and the ice maker duct 50 terminates at the downstream end with 5 flutes. There may also be any number of rows of ice wells 38, and the ice maker duct 50 may be configured to terminate in the appropriate corresponding number of flutes 56. The cross-sectional area of all of the flutes 56 at the downstream end proximate the ice tray is typically substantially the same. The flutes 56 terminate as close to the ice wells 38 as they can while still allowing the ice maker 20 to function normally. Typically, this means allowing for the ice tray 28 to be rotated and twisted to harvest the ice frozen in the ice tray 28 at any specified time.

The ice maker 20 may be located at an upper portion of the ice maker receiving space 21. The ice bin 34 may be located below the ice maker 20 such that as ice is harvested, the ice maker 20 uses gravity to transfer the ice from the ice maker 20 to the ice bin 34. The ice bin may include an ice bin base 36 and one or more ice bin walls 35 that extend upwardly from the perimeter of the ice bin base 36. The ice bin wall 35 may be made of a clear plastic material such as a copolyester so that a user can see through the bin wall 35 and into the bin 34 without removing the bin 34 from the door 16. The front ice bin wall 35 also typically extends higher than the other upwardly extending walls thereby forming a lip protection to further retain ice.

In operation, the ice maker 20 may begin an ice making cycle when a controller in electrical communication with the sensor or ice level input measuring system or device detects that a predetermined ice level is not met. In one embodiment, a bail arm attached to a position sensor is driven into the ice bin 34. If the bail arm is prevented from reaching a predetermined point in the ice bin 34, the controller reads this as "full", and the bail arm is returned to its home position. If the bail arm reaches the predetermined point, the controller reads this is as not "full." The ice in the ice tray 28 is harvested as described in detail below, and the ice tray 28 is then returned to its home position, and the ice making process as described in detail below may begin. In alternative embodiments, the sensor may also be an optical sensor, or any other type of sensor known in the art to determine whether a threshold amount of ice within a container is met. The sensor may signal to the controller, and the controller may interpret that the signal indicates that the threshold is not met.

When power is restored to the icemaker, the icemaker 20 checks whether the ice tray 28 is in home position. If the ice tray 28 is not in its home position, typically the controller sends a signal to the motor 24 to rotate the ice tray 28 back to its home position. Once the ice tray 28 is determined to be in its home position, the controller determines whether any previous harvests were completed. If the previous harvest was completed, the controller will typically send an electrical signal to open a valve in fluid communication with the ice maker 20. Either after a predetermined amount of valve open time or when the controller senses that a predetermined amount of water has been delivered to the ice tray 28, a signal will be sent by the controller to the valve to close the valve. The predetermined amount of water may be based on the size of the ice tray 28 and/or the speed at which a user would like ice, and may be set at the point of manufacture or based on an input from a user into a user interface 15. The valve will stay open typically between from about 7 to about 10 seconds or from 7 to 10 seconds. The water outlet may be positioned above the ice tray 28, such that the water falls with the force of gravity into the ice tray 28.

After the ice tray is filled, or if the controller determines that the previous harvest was not completed, the freeze timer typically is started and air at a temperature below the freezing point of water is forced from the freezing compartment 14 to the ice maker 20. The air may be forced by one or more fan or any other method of moving air known in the art. The air is directed from the freezer compartment 14 to the ice maker 20 via the duct system 110 or a series of ducts as discussed above that lead from an inlet in the freezing compartment 14, through the insulation of the refrigerator 10, and to an outlet in the refrigerator compartment 12 adjacent the ice maker 20. This air at a temperature below the freezing point of water is directed through the ice maker duct 50 and through the flutes 56 into at least substantially even distribution under the ice tray 28 to freeze the water within the ice wells 38 into ice pieces.

During the freezing process, the controller typically determines if a refrigerator door has been opened. If the door is determined to be open at any time, the freeze timer is paused until the door is closed. After some time, substantially all or all of the water will be frozen into ice. The controller may detect this by using a thermistor or other sensor. During the freezing process, the controller also typically determines if the temperature of the ice tray 28 or the temperature within the ice compartment is above a certain temperature for a certain amount of time. This temperature is typically between 20° F. and 30° F., and more typically from about 22° F. to about 28° F., and most typically about 25° F. If the controller determines that the temperature was above the specified temperature for longer than the specified time, the freeze timer typically resets.

When the freeze timer reaches a predetermined time, and when the thermistor sends an electrical signal to the controller that a predetermined temperature of the ice tray 28 is met, the controller may read this as the water is frozen, and it typically begins the harvesting process. The controller first will ensure that an ice bin 34 is in place below the ice tray 28 to receive the ice cubes. The ice maker 20 may have a proximity switch that is activated when the ice bin 34 is in place. The ice maker 20 may also utilize an optical sensor or any other sensor known in the art to detect whether the ice bin 34 is in place.

When the controller receives a signal that the ice bin 34 is in place, it will send a signal to the motor 24 to begin rotating. As the motor 24 begins rotating, the ice tray 28, which is rotationally engaged with the motor at a first end 30, rotates with it. The ice tray 28 typically begins at a substantially horizontal position. The motor 24 rotates the ice tray 28 to a predetermined angle. When the motor and tray reach the predetermined angle, a second end 32 of the ice tray 28 may be prevented from rotating any further by a bracket stop 100. With the second end 32 held in place by the bracket stop 100, the motor 24 continues to rotate the ice tray to a second predetermined angle. By continuing to rotate the first end 30, a twist is induced in the ice tray 28. The twist in the ice tray 28 induces an internal stress between the ice and the ice tray 28, which separates the ice from the ice tray 28. The twist angle may be any angle sufficient to break the ice loose from the ice tray 28.

After the rotation is complete, the motor returns to its home position. If the controller determines that the ice tray 28 reached the harvest position and back to home position, the cycle may begin again. If the controller determines that the ice tray 28 did not reach home position, it will re-attempt to move it back to the home position typically every 18-48 hours, and ideally every 24 hours.

Referring now to 7A-B, an air diverter 70 may be used to uniformly deliver the air flow under the ice wells 38. The air diverter 70 has a plurality of walls 74 arranged parallel to the flow of air that define channels 72 through which air is directed. Typically, the air diverter 70 has six walls 74 defining five channels 72, but there could be any number of channels. The number of channels 72 will typically correspond to the number of rows of ice wells 38 in the ice tray 28. The air diverter typically is located below the ice tray 28 to concentrate the air flowing through the bottom of the ice tray 28 around the ice wells 38. This concentration of airflow around the ice wells 38 speeds up the freezing process, decreasing the time necessary to freeze a tray of ice cubes.

Figure 7A:
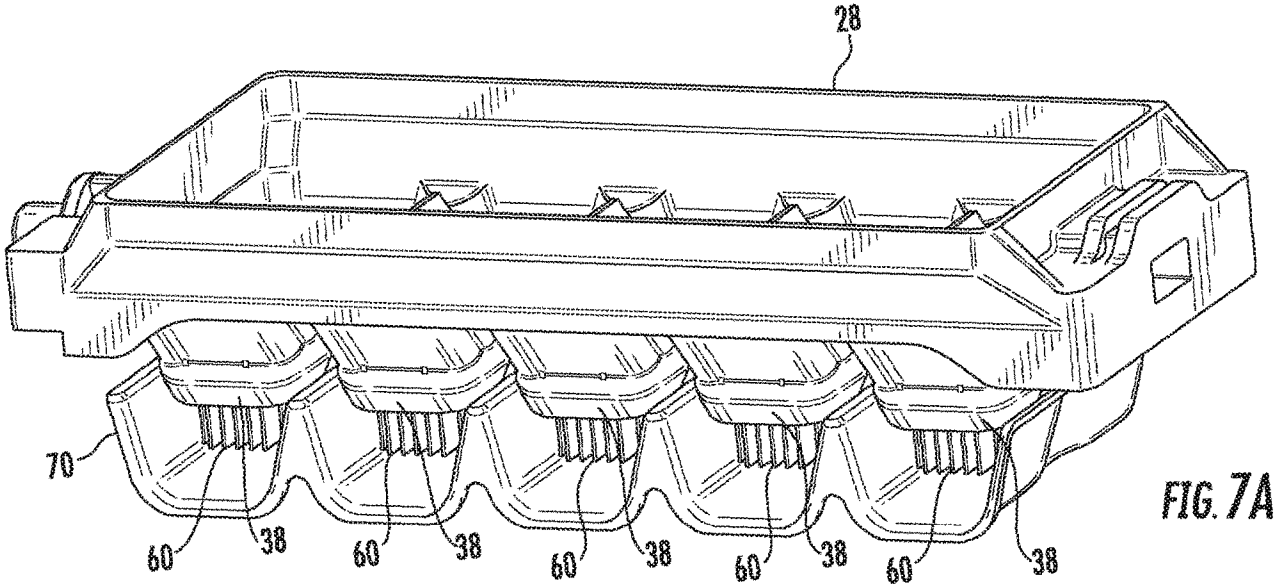
FIG. 7A-7B is a view of the ice tray with the air diverter installed and the air diverter by itself.
Figure 7B:
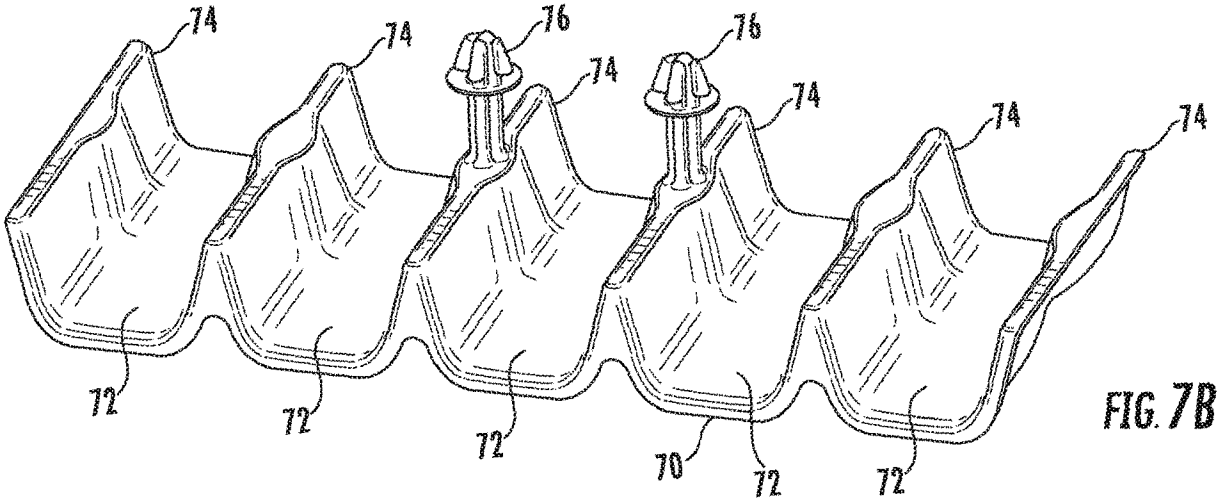
Figure 8A:
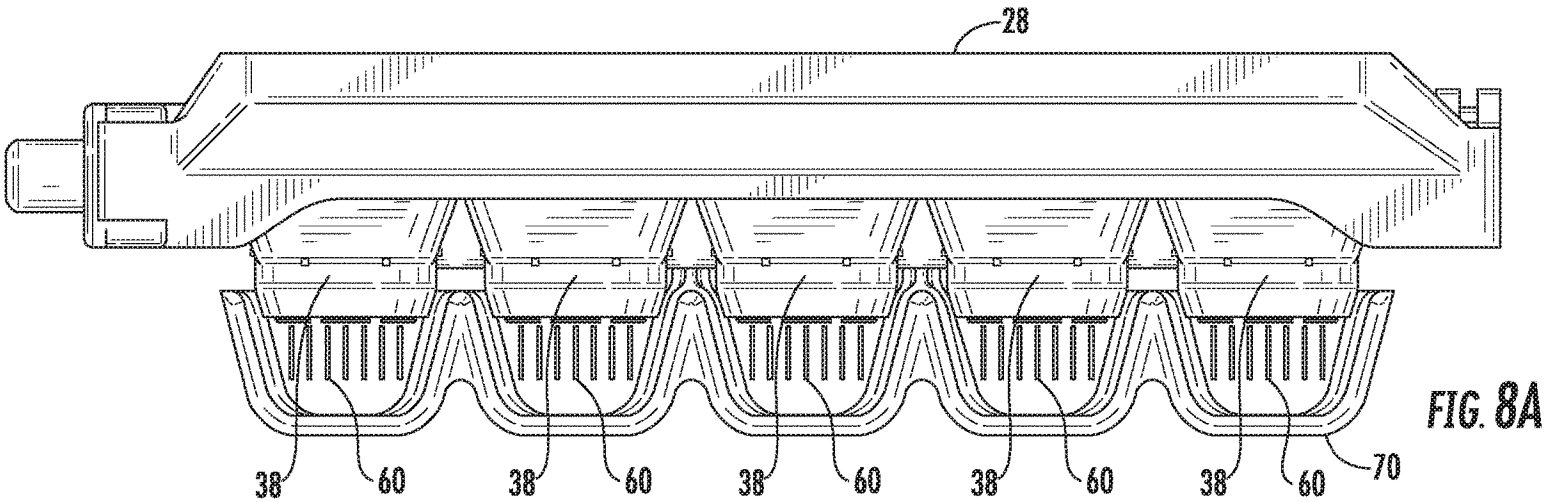
FIG. 8A-8B is a front elevation view of the ice tray with the air diverter and a cross-section of the ice tray with the air diverter showing the connection in detail.
Figure 8B:
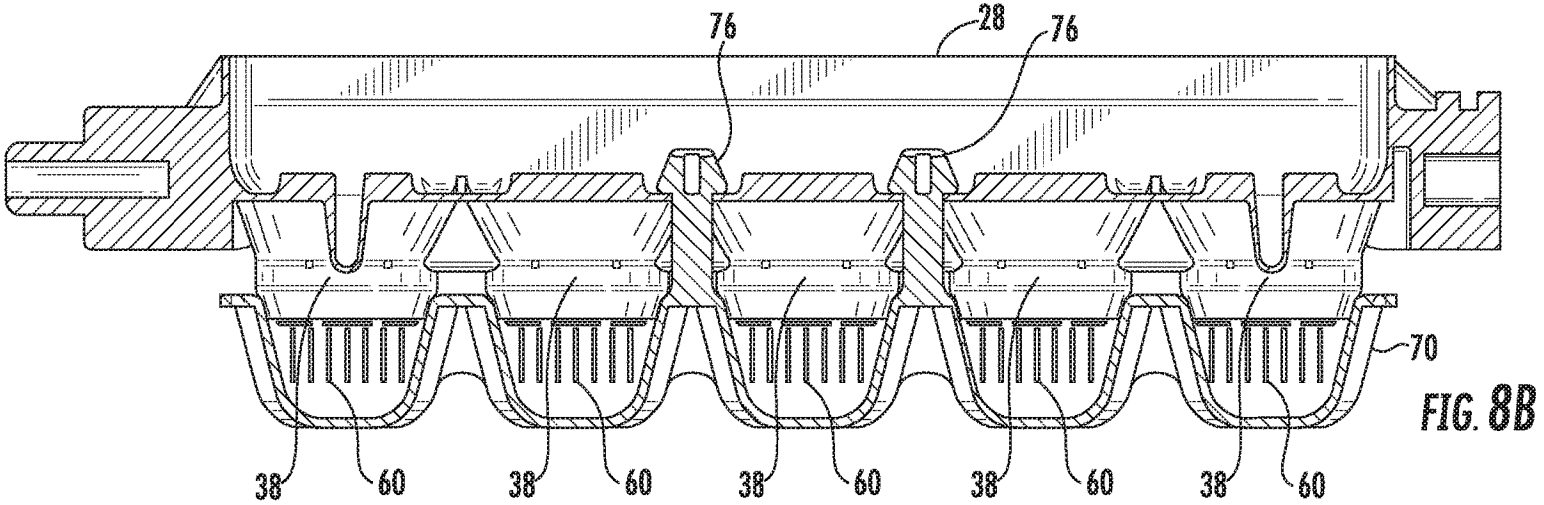

FIGS. 7A and 7B show the ice tray 28 and the air diverter 70 in more detail, with FIG. 7B showing a cross-section which details the connection between the diverter and the ice tray 28. The diverter 70 may have connecting posts 76 that are inserted into corresponding apertures in the ice tray 28 to secure the diverter 70 in place. The diverter 70 may also be coupled to the ice tray 28 by fasteners, or by any other method known the in the art. Ideally, the connecting posts 76 are used to allow for a minimal amount of relative motion between the ice tray 28 and the diverter 70 during the twisting motion of harvest. The air diverter 70 typically is substantially made of a plastic material like polypropylene or the like to allow for the limited amount of twisting that the air diverter is subjected to. When used in conjunction with the ice maker air duct 50, the channels 72 may line up with the flutes 56 when in the home position to minimize the amount of freezer air that is lost to the refrigerator compartment 12 during the freezing process.

Further speeding up the freezing process, a plurality of fins or vanes 60 may be attached to the bottom of the ice wells 38. The fins 60 extend in a downward direction from the bottom of the ice wells 38. The vanes 60 are typically substantially rectangular shaped and thin relative to the width of the air flow to allow as much of the airflow through the channels 72 without disturbing it. The fins 60 extend down from the ice wells 38 between the walls 74 into the airflow as it exits the flutes 56 and advances through the channels 72. The fins 60 are typically in thermal contact with the water in the ice wells 38. The fins 60 are typically made of a substantially metal or metal material such as aluminum or copper to transmit heat most effectively. Often, the bottom surface of the ice wells 38 is also made of the same metal material, and the fins 60 may be attached to the bottom of the ice wells, or more typically are integral with the bottom of the ice wells as one piece. In this way, the fins 60 may transmit heat most efficiently without have to transmit the heat through some adhesive. The fins may be attached to the ice tray 28 by snap-fit into the bottom of the ice tray 28 in each of the ice wells 38, or more typically by overmolding the ice tray over each of the fins.

As the air is advanced through the ice maker air duct 50, it is separated into individual airflows corresponding to the number of rows of ice wells 38. As shown, it is separated into five individual airflows. The air is forced by the fan into the inlet 52, through the duct 50, and out of the flutes 56. As the airflows exit the flutes 56, they enter the channels 72. Each airflow passes the fins 60, picking up the heat transmitted from the water in the ice wells 38. In this way, the heat within the water in the ice wells 38 is reduced quicker, and the ice freezes in less time than it would without the channels 72 or the fins 60.

It will be understood by one having ordinary skill in the art that construction of the described disclosure and other components is not limited to any specific material. Other exemplary embodiments of the disclosure disclosed herein may be formed from a wide variety of materials, unless described otherwise herein. It is within the scope of the present invention that a liquid other than water or ice may be dispensed from a storage location or directly from a supply of the liquid or other beverage. Primarily the present disclosure is directed to the use of filtered, treated or tap water received from a water source into the appliance and dispensed to the ice maker by the appliance either before or after being optionally filtered or otherwise treated. The water may also be treated with supplements like, for example, vitamins, minerals or glucosamine and chondroitin or the like.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate the many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within the described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A refrigerator appliance comprising:

a freezer compartment and a refrigerator compartment, wherein the freezer compartment is kept at a temperature below the freezing point of water, and wherein the refrigerator compartment is held at a temperature above the freezing point of water;

a door for selectively accessing an interior portion of the refrigerator appliance, the door comprising an ice compartment configured to house an ice maker;

a duct leading from the freezer compartment to the ice compartment, the duct comprising a duct inlet disposed in the freezer compartment, and a duct outlet disposed in the refrigerator compartment;

the ice maker disposed within the door and located within the ice compartment, the ice maker comprising an ice tray including a plurality of rows of ice wells;

an ice maker air duct disposed within the door, the ice maker air duct comprising an inlet and a plurality of flutes; wherein the inlet of the ice maker air duct is in fluid communication with the duct outlet, the plurality of flutes are configured to separate an air flow through the ice maker air duct into a plurality of substantially evenly distributed air flows;

each of the plurality of flutes terminate proximate a row of ice wells with each of the plurality of flutes having an opening width comprising a distance between adjacent flutes, wherein the opening width of each flute of the plurality of flutes proximate the row of ice wells is approximately as wide as the bottom of a corresponding ice well; and each of the plurality of rows of ice wells is supplied by air flow from one of the plurality of flutes and each of the plurality of flutes directs air flow toward a single row of ice wells.

2. The refrigerator appliance of claim 1, wherein the ice maker further comprises a motor coupled to a first end of the ice tray.

3. The refrigerator appliance of claim 2, wherein the ice maker is configured to twist the ice tray when ice within the ice tray is ready to harvest; and the ice maker is free of a heater capable of being used in conjunction with harvesting of ice from the ice maker.

4. The refrigerator appliance of claim 1, further comprising an air flow diverter disposed underneath the ice tray.

5. The refrigerator appliance of claim 4, wherein the air flow diverter comprises a plurality of air channels corresponding to and configured to direct air underneath each of the plurality of rows of ice wells with each of the plurality of air channels having an opening width comprising a distance between adjacent air channels of the plurality of air channels, wherein the opening width of each channel of the plurality of air channels is approximately as wide as the bottom of the corresponding ice well.

6. The refrigerator appliance of claim 5, wherein the air flow diverter is comprised of a polypropylene material and further comprises at least two upwardly extending connecting posts that are matingly received in apertures of the ice tray.

7. The refrigerator appliance of claim 5, wherein the plurality of air channels corresponds to and is configured to substantially line up with the plurality of flutes.

8. The refrigerator appliance of claim 4, wherein the air flow diverter is coupled with the ice tray and configured to rotate with the ice tray during harvesting of ice.

9. A refrigerator appliance comprising:

a freezer compartment and a refrigerator compartment, wherein the freezer compartment is kept at a temperature below the freezing point of water, and wherein the refrigerator compartment is held at a temperature above the freezing point of water;

a door for selectively accessing an interior portion of the refrigerator appliance, the door comprising an ice compartment configured to house an ice maker;

a duct leading from the freezer compartment to the ice compartment, the duct comprising a duct inlet disposed in the freezer compartment, and a duct outlet disposed in the refrigerator compartment;

the ice maker disposed within the door and located within the ice compartment, the ice maker comprising an ice tray including a plurality of rows of ice wells;

an air flow diverter coupled with the ice tray and disposed underneath the ice tray, the air flow diverter comprising a plurality of air channels corresponding to and configured to direct air underneath the plurality of rows of ice wells with each of the plurality of air channels having a channel width comprising a distance between adjacent air channels of the plurality of air channels, wherein the channel width of each air channel of the plurality of air channels is approximately as wide as the bottom of a corresponding ice well; and each of the plurality of rows of ice wells supplied by air flow through one of the plurality of air channels and each of the plurality of air channels supplies air flow to one of the plurality of rows of ice wells.

10. The refrigerator appliance of claim 9, further comprising an ice maker air duct disposed within the door, the ice maker air duct comprising an inlet and a plurality of flutes.

11. The refrigerator appliance of claim 10, wherein the ice maker air duct inlet is in fluid communication with the duct outlet.

12. The refrigerator appliance of claim 11, wherein the plurality of flutes are configured to separate an air flow through the ice maker air duct into a plurality of substantially evenly distributed air flows.

13. The refrigerator appliance of claim 12, wherein each of the plurality of flutes terminates proximate to and corresponds to one of the plurality of air channels and directs distributed air flow towards the respective air channel.

14. The refrigerator appliance of claim 9, wherein the ice maker further comprises a motor coupled to a first end of the ice tray and the ice maker is free of a heater.

15. The refrigerator appliance of claim 10, wherein the ice maker is configured to twist the ice tray when ice within the ice tray is ready to harvest and each of the plurality of flutes have a curved line which increases in length proportionate to an increase in distance between each of the plurality of flutes and the ice maker air duct inlet.

16. The refrigerator appliance of claim 15, wherein the air flow diverter is coupled with the ice tray and configured to rotate with the ice tray during harvesting of the ice.

17. The refrigerator appliance of claim 16, wherein the air flow diverter is comprised of a polypropylene material and further comprises at least two upwardly extending connecting posts that are matingly received in apertures of the ice tray.

18. A refrigerator comprising:

a freezer compartment and a refrigerator compartment, wherein the freezer compartment is kept at a temperature below the freezing point of water, and wherein the refrigerator compartment is held at a temperature above the freezing point of water;

a door for selectively accessing an interior portion of the refrigerator, the door comprising an ice compartment configured to house an ice maker;

a duct leading from the freezer compartment to the ice compartment, the duct comprising a duct inlet disposed in the freezer compartment, and a duct outlet disposed in the refrigerator compartment;

the ice maker disposed within the door and located within the ice compartment, the ice maker comprising an ice tray including a plurality of rows of ice wells;

an air flow diverter coupled with the ice tray and disposed underneath the ice tray, the air flow diverter comprising a plurality of air channels corresponding to and configured to direct air underneath the plurality of rows of ice wells with each of the plurality of air channels having an opening width comprising a distance between adjacent air channels of the plurality of air channels, wherein the opening width of each channel of the plurality of air channels is approximately as wide as the bottom of a corresponding ice well;

an ice maker air duct disposed within the door, the ice maker air duct comprising an inlet and a plurality of flutes; wherein:

the inlet of the ice maker air duct is in fluid communication with the duct outlet;

the plurality of flutes are configured to separate an air flow through the ice maker air duct into a plurality of substantially evenly distributed air flows;

each of the plurality of flutes terminate proximate a row of ice wells with each of the plurality of flutes comprising a pair of adjacent flute walls, a flute inlet at an upstream end of the adjacent flute walls, and a flute outlet at a downstream end of the adjacent flute walls;

each of the plurality of flute outlets having an opening width comprising a distance between adjacent flute walls, wherein the opening width is at least as wide as the bottom of the corresponding ice well;

each of the plurality of flute inlets having an opening width comprising a distance between adjacent flute walls, wherein the opening width of the flute inlets located closer to the ice maker air duct inlet are less than the opening width of the flute inlets located farther away from the ice maker air duct inlet;

each of the plurality of rows of ice wells is supplied by air flow from one of the plurality of flutes that is directed into one of the plurality of air channels; and each of the plurality of flutes directs air flow toward a single row of ice wells.

19. The refrigerator of claim 18, wherein the ice maker further comprises a motor coupled to a first end of the ice tray and wherein the ice maker is configured to twist the ice tray when ice within the ice tray is ready to harvest without the use of a heater.

20. The refrigerator of claim 19, wherein each of the plurality of flutes have a curved line which increases in length proportionate to an increase in distance between each of the plurality of flutes and the ice maker air duct inlet.

* * * * *